US008336165B2

(12) United States Patent
Finke et al.

(10) Patent No.: US 8,336,165 B2
(45) Date of Patent: Dec. 25, 2012

(54) UPRIGHT VACUUM CLEANER

(75) Inventors: Christian Finke, Bielefeld (DE); Michael Poetting, Bielefeld (DE)

(73) Assignee: Miele & Cie. KG, Guetersloh (DE)

( * ) Notice: Subject to any disclaimer, the term of this patent is extended or adjusted under 35 U.S.C. 154(b) by 1153 days.

(21) Appl. No.: 12/199,455

(22) Filed: Aug. 27, 2008

(65) Prior Publication Data

US 2009/0056058 A1 Mar. 5, 2009

(30) Foreign Application Priority Data

Aug. 30, 2007 (DE) ..... 10 2007 040 961

(51) Int. Cl.
*A47L 9/10* (2006.01)

(52) U.S. Cl. ..... 15/411; 15/350

(58) Field of Classification Search ..... 15/350, 15/351, 410, 411; *A47L 9/10*
See application file for complete search history.

(56) References Cited

U.S. PATENT DOCUMENTS

| | | | |
|---|---|---|---|
| 2,672,642 | A | 3/1954 | Tamarin et al. |
| 2,806,242 | A | 9/1957 | Sparklin |
| 3,797,064 | A | 3/1974 | MacFarland |
| 3,932,912 | A | 1/1976 | Johnson |
| 4,129,920 | A | 12/1978 | Evans et al. |
| 4,423,534 | A | 1/1984 | Lyman et al. |
| 5,323,510 | A | 6/1994 | Redding |
| 5,584,095 | A | 12/1996 | Redding |
| 5,617,611 | A | 4/1997 | Woerwag |
| 5,794,305 | A | 8/1998 | Weger |
| 6,055,703 | A | 5/2000 | Redding |
| 6,148,473 | A | 11/2000 | Embree et al. |
| 6,277,164 | B1 | 8/2001 | Embree et al. |
| 7,159,277 | B2 | 1/2007 | Steiner et al. |
| 7,610,653 | B2 | 11/2009 | Courtney |
| 2003/0131440 | A1 | 7/2003 | Illingworth |
| 2006/0080803 | A1 | 4/2006 | Stein |
| 2009/0056057 | A1 | 3/2009 | Poetting |
| 2009/0056058 | A1 | 3/2009 | Finke et al. |
| 2009/0056059 | A1 | 3/2009 | Mersmann et al. |
| 2009/0056063 | A1 | 3/2009 | Poetting |
| 2009/0056068 | A1 | 3/2009 | Iseringhausen et al. |

FOREIGN PATENT DOCUMENTS

DE 195 25 796 A1 1/1997

(Continued)

OTHER PUBLICATIONS

European Search Report of EP 08 01 4677, dated Sep. 29, 2011.

(Continued)

*Primary Examiner* — David Redding
(74) *Attorney, Agent, or Firm* — Leydig, Voit & Mayer, Ltd.

(57) ABSTRACT

An upright vacuum cleaner for cleaning a surface includes an upper body having a dust collection container disposed therein, a base unit and a carriage configured to move the base unit on the surface. A tilting joint is disposed between the base unit and the upper body. The tilting joint is operable to provide tilting of the upper body relative to the base unit about a horizontal axis from a vertical parked position to an inclined tilted operating position. A swivel joint is disposed between the base unit and the upper body. The swivel joint is operable to provide a change in a direction of travel of the base unit by twisting the upper body. A rotation-locking device is configured to lock the upper body against rotation when the vacuum cleaner is in the parked position.

7 Claims, 6 Drawing Sheets

FOREIGN PATENT DOCUMENTS

| | | | |
|---|---|---|---|
| EP | 0708613 | | 5/1996 |
| EP | 0909546 | | 4/1999 |
| EP | 1647219 | A2 | 4/2006 |
| EP | 1782724 | | 5/2007 |
| GB | 2422094 | A | 7/2006 |
| WO | WO 0059360 | A1 | 10/2000 |
| WO | WO-0228257 | | 4/2002 |
| WO | WO-2004014209 | | 2/2004 |
| WO | WO-2007008770 | | 1/2007 |

OTHER PUBLICATIONS

European Search Report of EP 08 01 4412, dated Jul. 11, 2011.

UPRIGHT VACUUM CLEANER

CROSS REFERENCE TO RELATED APPLICATIONS

Priority is claimed to Germany patent application DE 10 2007 040 961.5, filed Aug. 30, 2007, which is hereby incorporated by reference herein.

FIELD

The present invention relates to a vacuum cleaner of the upright type, including an upper body containing a dust collection container, a base unit, and a carriage permitting said base unit to move on the surface to be cleaned.

BACKGROUND

The following is a description of three types of vacuum cleaners which differ in design and operation. All of them have, as common features, a motor-driven fan, a dust collection chamber, and one or more floor treatment devices which are each adapted for a particular purpose.

The canister vacuum cleaner has a housing which can be moved on the floor to be cleaned on wheels and/or runners. The housing contains the motor-fan unit and the dust collection container. The floor treatment device, here referred to as floor nozzle, is connected to the dust collection chamber via a suction hose, and possibly a suction wand connected therebetween. During vacuuming, the housing is moved to the desired position by pulling on the suction wand.

In a stick vacuum cleaner, the motor-fan unit and the dust collection container are also disposed in a housing. A suction wand extends from one end of the housing, connecting the floor nozzle to the dust collection container, and a handle used to maneuver the housing to the desired position extends from the other end.

Uprights do not have as strictly divided a configuration as the two aforementioned types. One feature of an upright is a movable base unit which carries an upper body containing a large dust collection container. The two parts are tiltable relative to each other and can usually be locked in a parked position in which the upper body is nearly upright when the base unit is located on a horizontal floor in a position of use. In this position, which is a locked position in terms of the tilting motion, the upright stands unsupported. During vacuuming, the above-described locked engagement is released, and the upper body is tilted through a certain angle to an operating position. The tilt angle depends on the height of the user and on the particular purpose of use. A handle is provided on the upper body for maneuvering the entire appliance. The upright described in WO 2007/008770 A2, for example, has the drawback that it is difficult to move from a straight path of travel into a curved path of travel. EP 0 708 613 A1 describes providing a point of rotation between the upper body and the upper region of the fan. This enables the upright to move along curved paths, thereby improving maneuverability. If the upper body is then rotated while in the parked position, there is a risk of the upright's center of gravity being moved out of its footprint area, causing the appliance to tip over.

SUMMARY

An aspect of the present invention is to provide an upright vacuum cleaner in which the vertical stability is increased.

In an embodiment, the present invention provides an upright vacuum cleaner for cleaning a surface. The upright vacuum cleaner includes an upper body having a dust collection container disposed therein, a base unit and a carriage configured to move the base unit on the surface. A tilting joint is disposed between the base unit and the upper body. The tilting joint is operable to provide tilting of the upper body relative to the base unit about a horizontal axis from a vertical parked position to an inclined tilted operating position. A swivel joint is disposed between the base unit and the upper body. The swivel joint is operable to provide a change in a direction of travel of the base unit by twisting the upper body. A rotation-locking device is configured to lock the upper body against rotation when the vacuum cleaner is in the parked position.

BRIEF DESCRIPTION OF THE DRAWINGS

Exemplary embodiments of the present invention will be described below and are shown schematically in the drawings, in which.

DETAILED DESCRIPTION

The present invention relates to an upright vacuum cleaner including an upper body containing a dust collection container, a base unit, a carriage permitting said base unit to move on the surface to be cleaned, and a tilting joint which is located between the upper body and the base unit and by which the upper body, when in a position of use, can be tilted relative to the base unit about a horizontal axis from an at least nearly vertical parked position to an inclined tilted operating position, and a swivel joint which is located between the upper body and the base unit and allows the direction of travel of the moving base unit to be changed by twisting the upper body.

In an embodiment, the rotation-locking device includes a first spring-mounted pin which, in the parked position, engages a bore. This allows automatic locking without the user having to take any action. Further the vacuum cleaner can include means which move the pin out of the bore when the upper body is pivoted from the parked position to the operating position. To this end, the means may include an upwardly sloping cam surface and a second pin which is spring-mounted to the first pin. The first pin may be disposed on a yoke-shaped member which is a pivotable part of the tilting joint and a stationary part of the swivel joint.

In another embodiment, the rotation-locking device includes a locking pin cooperating with a substantially V-shaped guide, the guide locking the pin in a first pivoted position and releasing it from the pivoted position when the upper body is moved out of the pivoted position.

The upright vacuum cleaner shown in different views in FIGS. 1 through 6 (hereinafter abbreviated as upright 1) includes a base unit 2, an upper body 3, and a joint disposed therebetween, which will be described in greater detail further on in this specification.

Figure 7:
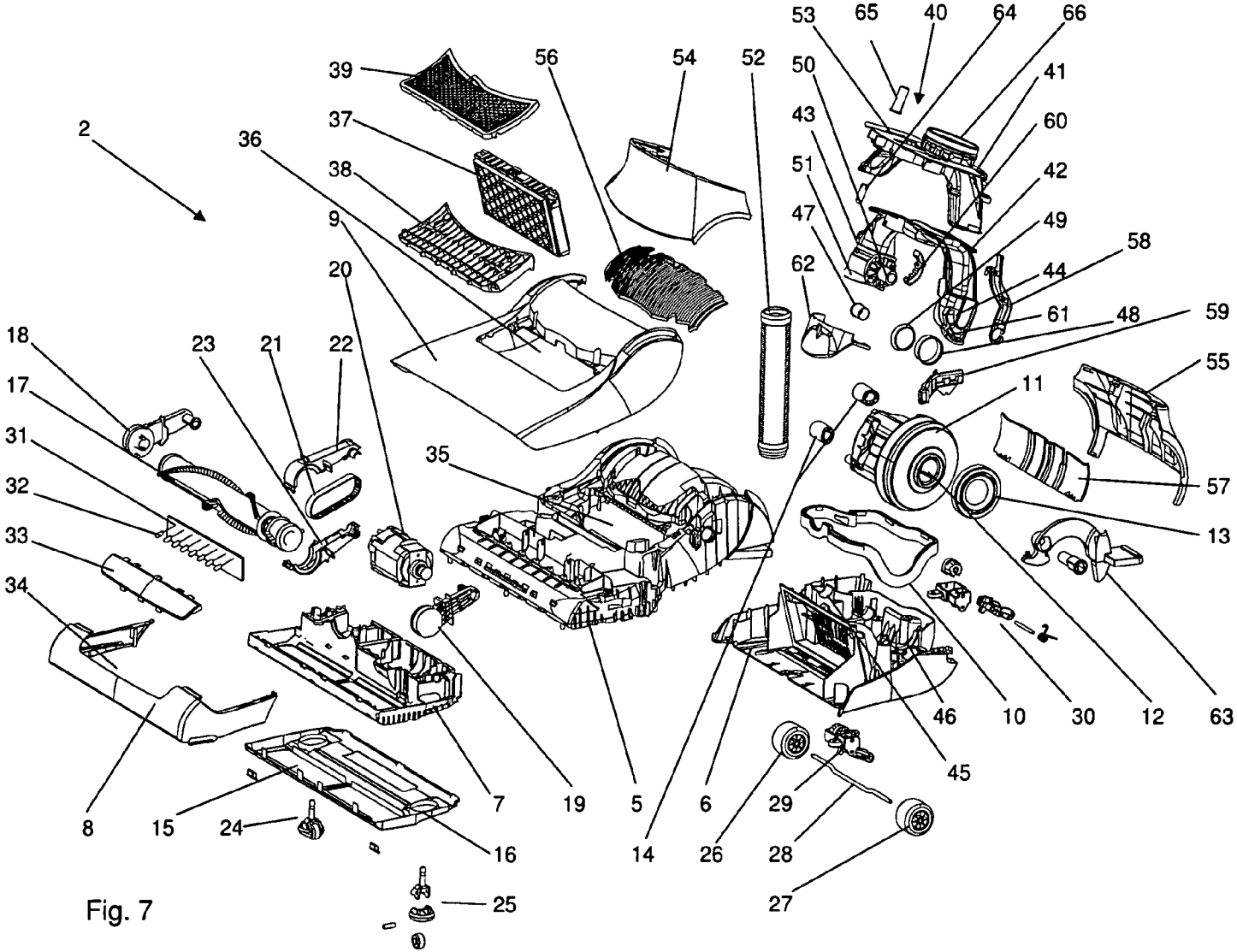
FIG. 7 is an exploded view showing the base unit of the vacuum cleaner.

Upright 1 can be brought from an upright position (see FIGS. 1 through 3), in which it can be locked and stand unsupported, to a tilted position (FIGS. 4 and 5), or even to a fully flat position (FIG. 6), after the locked engagement has been released (see FIG. 7). To this end, base unit 2 and upper body 3 are connected in such a manner that they can be tilted relative to each other about an axis X extending horizontally in a position of use (see FIG. 5). This pivoting movement is made possible by a joint which is hereinafter referred to as a "tilting joint". In the tilted position, the upright can be rotated about an axis Y, as is also shown in FIG. 5. The user can maneuver base unit 2 through curves by rotating upper body 3 about the aforesaid axis using handle 4 while simultaneously pulling or pushing the upright. The corresponding joint is hereinafter referred to as a "swivel joint".

Base unit 2, shown in the exploded view of FIG. 7, has a housing including a housing insert 5, a lower rear housing part 6, a lower front housing part 7, a bumper strip 8, and a cover part 9. Housing insert 5 functions as a support for a number of electrical and mechanical components. The aforementioned housing parts are also attached thereto. The housing insert, lower rear housing part 6, and a motor chamber seal 10 placed therebetween, together form a chamber for receiving a motor-fan unit 11 for creating the partial vacuum required for vacuuming. A sealing ring 13 is provided around fan inlet 12 on the suction side, said sealing ring also bearing against the two aforementioned housing parts 5 and 6. Rubber buffers 14 are inserted on the opposite side. For deep cleaning of carpets, a brush roller 17 extends into suction mouth 15, which is an opening in lower front housing part 7 and bottom plate 16, which is attached thereto, said brush roller being resiliently mounted on two lateral pivoting arms 18 and 19 and being driven by a brush motor 20 via a belt 21. A two-part belt cover is provided by parts 22 and 23. Brush motor 20 is also attached to housing insert 5, and pivoting arms 18 and 19 are pivotably secured thereto. The carriage of the upright is formed by front casters 24 and 25 and rear wheels 26 and 27 and is supported by the two lower housing parts 6 and 7. Rear wheels 26 and 27 are connected by an axle 28 for purposes of stability, and are adjustable in position by means of a wheel mechanism 29 and 30, respectively. A circuit board 31 carrying LEDs 32 is secured to housing insert 5 to illuminate the travel path and is covered at the front by a transparent plate 33. Transparent plate 33 is held in a cut-out 34 in bumper strip 8.

The air generated by the motor-fan unit 11 is discharged into the environment through an opening 35 in housing insert 5 and a corresponding opening 36 in cover part 9. A filter frame 37 is inserted into opening 36 to hold an exhaust filter (not shown) for removing ultrafine particles from the exhaust air. Filter frame 37 is covered by a grating holder 38 and a grating 39 within cover part 9, from where it can be replaced.

Both the tilting joint and the swivel joint between base unit 2 and upper body 3, which will be described in greater detail hereinafter, are provided by a rigid, yoke-shaped duct member. This member also contains portions of the air passageway from suction mouth 15 to upper body 3, and the air passageway from upper body 3 to the exhaust port (openings 35 and 36). This member is hereinafter referred to as yoke 40. It is formed by two plastic parts, namely an upper shell 41 and a lower shell 42, which are welded together. In order to create the tilting joint, the two ends 43 (right) and 44 (left) of yoke 40 are pivotably mounted in openings 45 and 46 provided for this purpose, and are surrounded by metal bearing sleeves 47 and 48, respectively, in order to avoid wear. Yoke end 44, which is on the left side as viewed in the direction of travel, is hollow and is coupled to fan inlet 12 via a seal 49. A trunnion 50 is integrally formed with yoke end 43, which is on the right side as viewed in the direction of travel. Moreover, the right yoke end has an opening 51 which is connected by a flexible tube 52 to suction mouth 15. In order to prevent the interior of base unit 2 from becoming visible when tilting the upper body 3, the connecting portion between the two yoke ends 43 and 44 (hereinafter referred to as bridge portion 53) is enclosed by a front cover 54 and a rear cover 55, which are provided on base unit 2 and are capable of following the swivel motion of yoke 40. The gap between the front and rear covers and housing insert 5 is bridged by covering members or skirts 56 and 57. The first 58 of two cable ducts 58 and 59 is attached to left yoke end 44. Furthermore, yoke ends 43 and 44 carry toothed segments 60 and 61, which cooperate with wheel mechanisms 29 and 30. A covering cap 62 for a connecting cable is secured to bridge portion 53. To enable the upright to be locked in the upright position (FIGS. 1 through 3) in terms of the tilting motion, a foot pedal 63 is mounted on housing insert 5 which, in this position, engages with left yoke end 44, thereby preventing yoke 40 from swiveling. The locked position can be released by depressing pedal 63. Moreover, in the locked position, swivel motion is prevented by two spring-mounted pins 64 and 65. In the region of bridge portion 53, the air passages provided by yoke ends 43 and 44 are combined into a first section 66 of a coaxial conduit.

Figure 8:
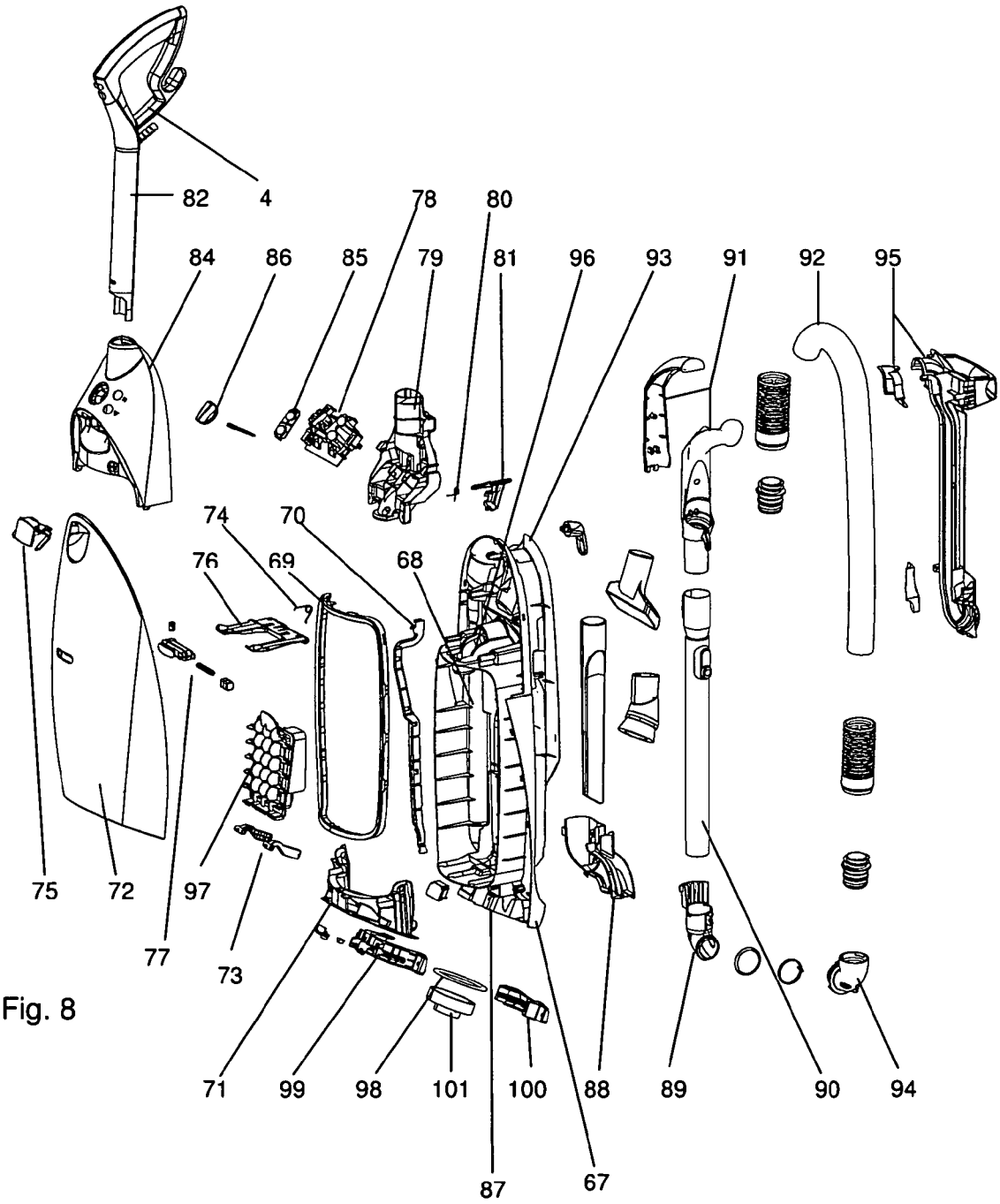
FIG. 8 is an exploded view illustrating the upper body of the vacuum cleaner.

FIG. 8 shows upper body 3, also in an exploded view. The load-bearing part of upper body 3 is a rear wall 67. The aforesaid rear wall forms the rear portion of dust chamber 68, which in turn receives a filter bag. A seal 69 surrounds the edge of dust chamber 68, and a covering strip 70 for cables is attached at the side. A hinge bearing 71 is secured to rear wall 67 in the lower portion thereof. Dust chamber 68 is closed at the front by an upper housing part 72 which is pivoted to hinge bearing 71 by hinges 73 and torsion springs 74. Upper housing part 72 carries a locking device 75, a dust bag holder 76, and a filter replacement indicator 77 and, in addition, serves to cover hinge bearing 71. In the upper portion, rear wall 67 carries the electronics 78 of the upright, which are completely arranged on a holder 79 and can be installed as a pre-tested subassembly. A lever 81 for turning off brush motor 20 is mounted to the holder via a torsion spring 80. In addition, said holder is used to hold handle tube 82 and appliance handle 4. Electronics 78 are covered by a cap 84, which also serves for attachment of various controls and indicators and accessories thereof (transparent cover 85, rotary knob 86).

An air path system allows dirt-laden air to be optionally sucked in either through the suction mouth in the base unit or through a telescoping wand to which may be attached vacuum attachments such as a crevice tool, a dusting brush, an upholstery tool, etc. To this end, the suction air is directed from suction mouth 15 through flexible tube 52 and right yoke end 43, and further through the inner tube of first section 66 of the coaxial conduit in bridge portion 53 into the inner tube of a second section 87 of the coaxial conduit. This section 87 is continued in rear wall 67, where it is divided into two separate conduits. The air path continues through a suction duct member 88 into an elbow 89. A telescoping wand 90 is loosely, and therefore removably, inserted into elbow 89. The aforesaid telescoping wand merges into a wand handle 91 and further into a flexible suction hose 92. Suction hose 92 is held in a receiving structure 93 provided for this purpose, as can be seen also in FIG. 3. The air passes through a swivel elbow 94 into a duct which extends along the entire length of rear wall 67. The duct is defined by rear wall 67 itself and an air duct member 95 placed thereon. A downstream, elbow-shaped duct member 96, which is formed by rear wall 67 and a portion of electronics holder 79, directs the dirt-laden suction air into the region of dust bag holder 76, and there into a dust bag. Once the suction air has passed through the dust bag in the dust chamber and been cleaned of dust therein, it passes through a motor protection filter (the figure shows only the frame 97 for holding the filter) and into the outer annulus of second section 87 of the coaxial conduit, and from there through first section 66 and left yoke end 44 to motor-fan unit 11.

The lower portion of FIG. 8 further shows the components used for attaching and rotatably supporting upper body 3 on yoke 40. First section 66 of the coaxial conduit is surrounded by a metal ring 98 which is enclosed by injection-molded material and projects beyond the outside diameter of said section 66, and which is held around its circumference in two bearing shells 99 and 100. Bearing shells 99 and 100 are connected to upper body 3. Accordingly, metal ring 98 and bearing shells 99 and 100 together form the swivel joint of upright 1. When joining upper body 3 and yoke 40, the two sections 66 and 87 of the coaxial conduit are joined together with a seal 101 interposed therebetween.

As already described above, upper body 3 can, first of all, be locked in the parked position in terms of a pivoting, i.e., tilting motion, and, secondly, rotation can be prevented in this position. To this end, a rotation-locking device is provided.

Figure 9A:
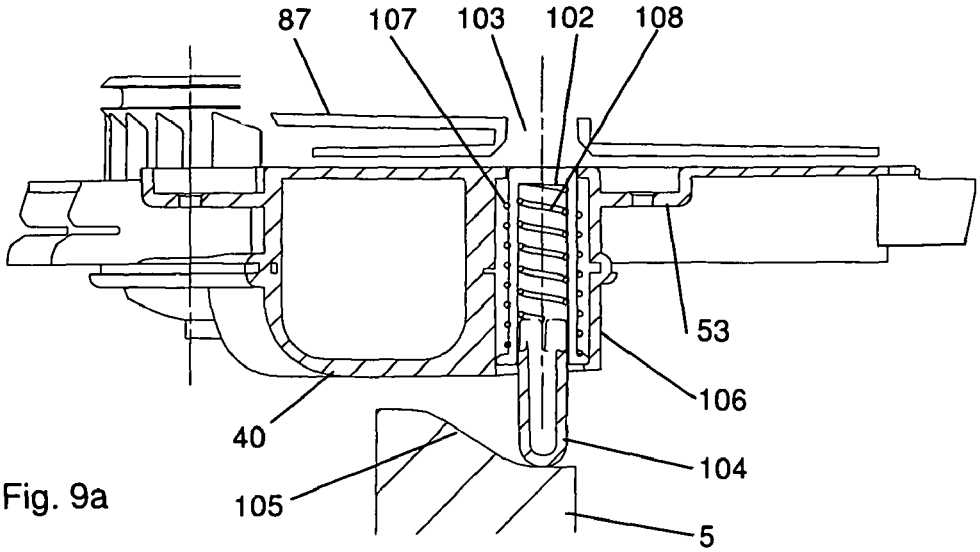
FIGS. 9*a* through 9*c* are schematic cross-sectional views of a first rotation-locking device.
Figure 9B:
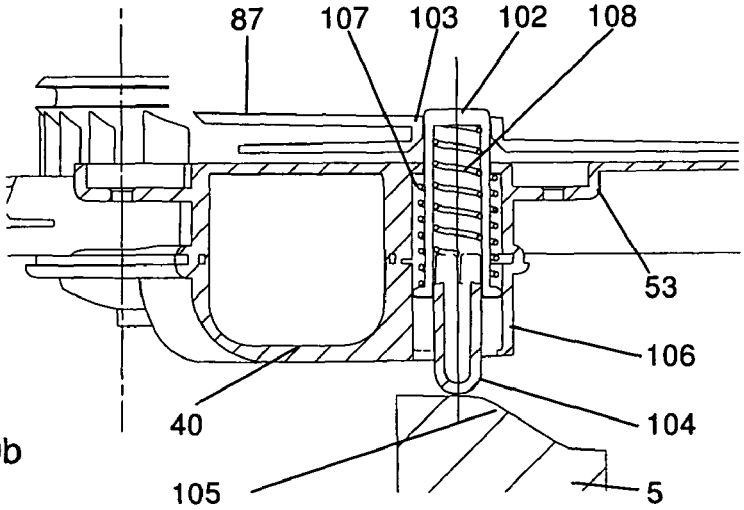
Figure 9C:
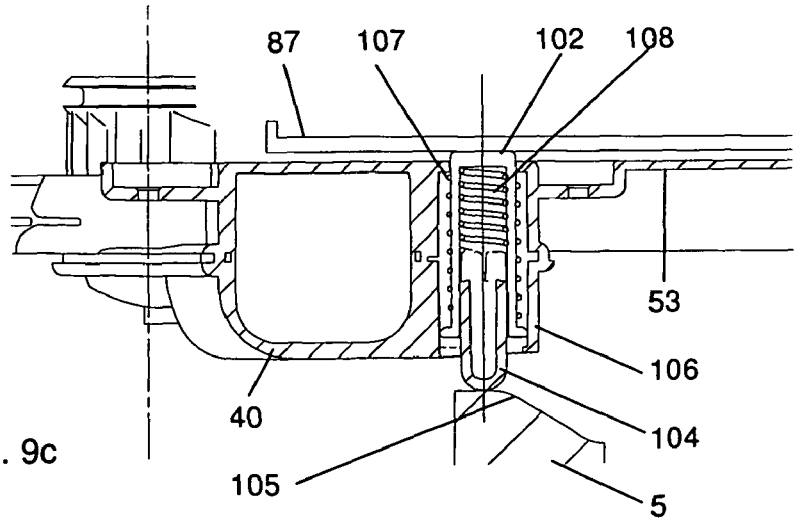

The following is a description of the operation of an embodiment which was already briefly mentioned in connection with the description of FIG. 7. FIGS. 9*a* through 9*c* are schematic cross-sections through the appliance components that are used for the operation of such a device in accordance with this embodiment, namely housing insert 5, yoke 40, and rear wall 67. The operation of the shown variant of the rotation lock uses two nested pins, of which an outer pin 102 engages a bore 103 in the underside of rear wall 67, and an inner pin 104 cooperates with an upwardly sloping cam surface 105 on housing insert 5. Outer pin 102 is supported in a sleeve 106 on bridge portion 53 and can be moved out of said sleeve against the force of an outer spring 107. Inner pin 104 can be pushed into hollow outer pin 102 against the force of an inner spring 108. The spring constant of inner spring 108 is greater than that of outer spring 107, so that a pressure exerted on inner pin 104 will initially cause outer pin 102 to move out of sleeve 106.

Figure 3:
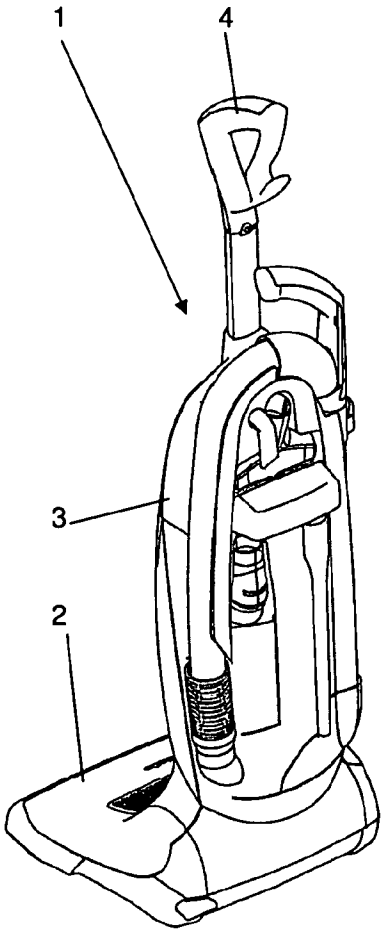
FIGS. 1 through 6 show various overall views of the vacuum cleaner of the present invention.
Figure 2:
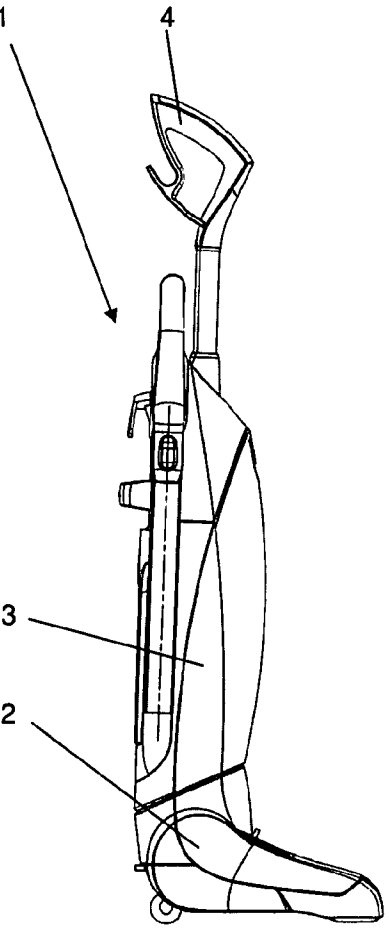
Figure 1:
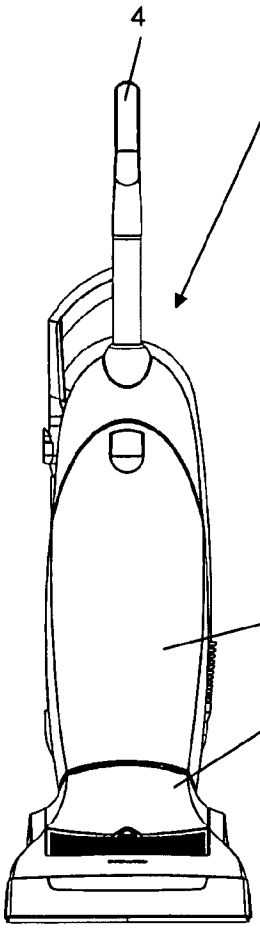
Figure 4:
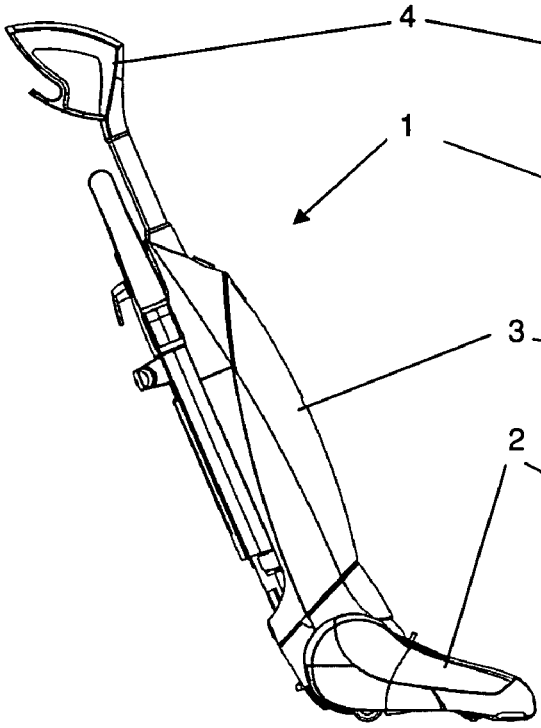
Figure 5:
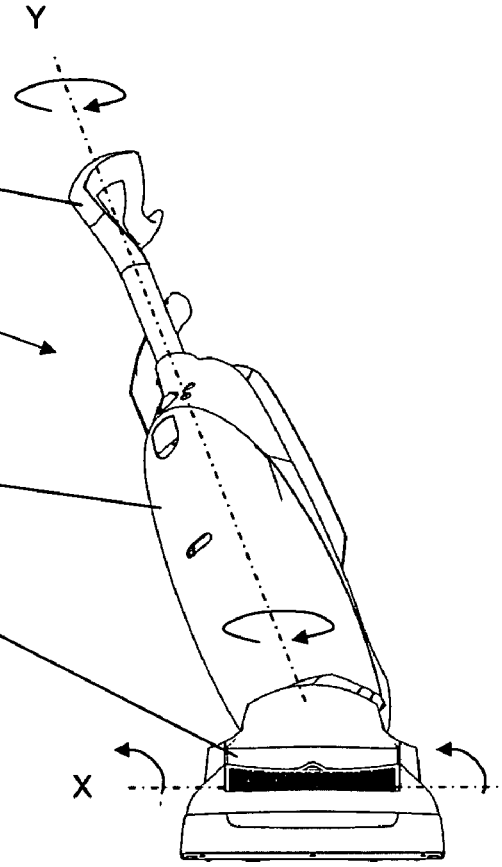
Figure 6:
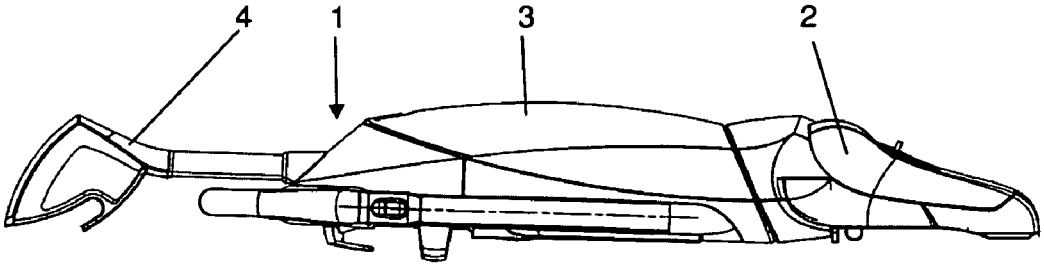

FIG. 9*a* shows the rotation-locking device in a condition in which upper body 3 is in a tilted operating position, such as in FIG. 4. The position of bore 103 directly above outer pin 102 reveals that, unlike in FIG. 5, upper body 3 is not in a rotated position. Inner pin 104 is in a region in front of upwardly sloping cam surface 105, so that both inner spring 108 and outer spring 107 are extended to their maximum possible lengths.

If upper body 3 is tilted from this position to the parked position (FIGS. 1 through 3) by a pivoting movement, upwardly sloping cam surface 105 pushes inner pin 104 upward, see FIG. 9*b*. Due to the greater force of inner spring 108, the inner pin compresses outer spring 107, moving outer pin 102 into bore 103. Thus, upper body 3 is locked against rotational movement.

If upper body 3 is tilted from a rotated position shown in FIG. 5 to the parked position, it can indeed be locked against tilting movement when in the upright position, but not against rotational movement. This informs the user that upper body 3 is still in a position in which upright 1 does not stand stably. In such a condition, as is shown in FIG. 9*c*, inner pin 104 has indeed been moved onto the upwardly sloping cam surface 105 and pushed upward, but outer pin 102 has not yet found bore 103. Therefore, only inner spring 104 is compressed. The rotationally locked condition shown in FIG. 9*b* can be achieved only after upper body 3 has rotated to a position in which outer pin 102 is in alignment with bore 103.

Figure 10:
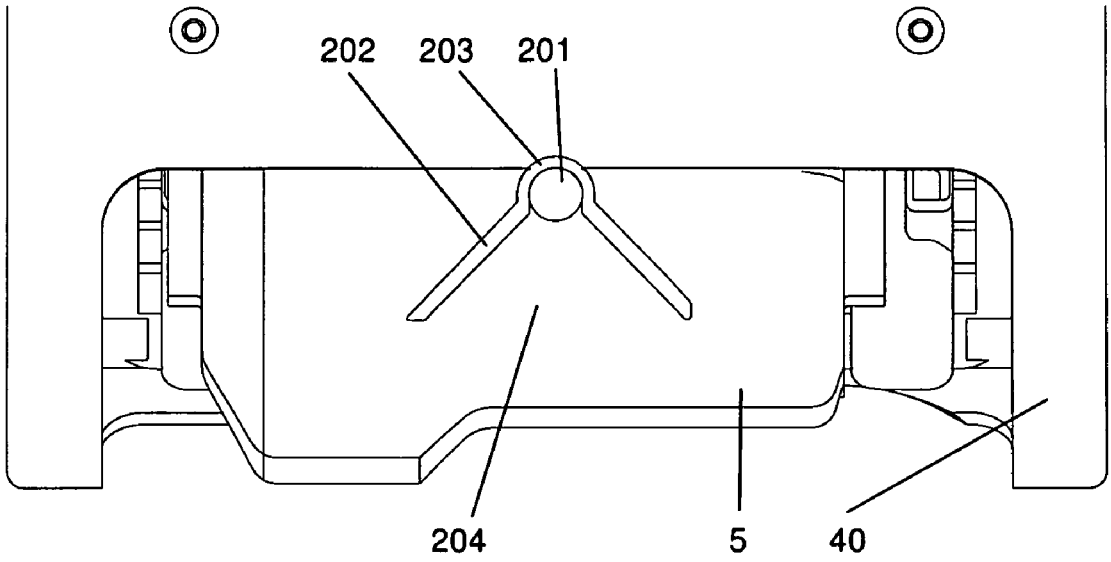
FIG. 10 is a schematic cross-sectional view of a second rotation-locking device.

FIG. 10 is a schematic view showing another embodiment of a rotation-locking device. In this variant, a locking pin 201 is provided on the underside of rear wall 67. During a pivoting movement of upper body 3 toward the parked position, locking pin 201 moves into the range of action of a V-shaped guide 202 disposed on the housing insert. During further pivoting movement to the parked position, locking pin 201 moves into the peak 203 of guide 202, where it is locked in position. Then, upper body 3 is no longer able to rotate. Tilting upper body 3 to the operating position causes pin 201 to move from peak 203 to the wider portion 204 of guide 203, where the locked engagement is released and rotation is possible again. This variant of the rotation lock allows pin 201 to center itself within guide 202. Here, there is no possibility of upper body 3 being pivoted into the parked position while in a rotated state. However, the the entire pivoting range between pin 201 and guide 202 is outside the pivoting path of yoke 40. This would require a modified yoke which may occupy much more space.

The present invention has been described herein based on one or more exemplary embodiments, but is not limited thereto. Reference should be had to the appended claims.

What is claimed is:

1. An upright vacuum cleaner for cleaning a surface, the upright vacuum cleaner comprising:

an upper body having a dust collection container disposed therein;

a base unit;

a carriage configured to move the base unit on the surface;

a tilting joint disposed between the base unit and the upper body, the tilting joint being operable to provide tilting of the upper body relative to the base unit about a horizontal axis from a vertical parked position to an inclined tilted operating position;

a swivel joint disposed between the base unit and the upper body, the swivel joint being operable to provide a change in a direction of travel of the base unit by twisting the upper body; and a rotation-locking device configured to lock the upper body against rotation when the vacuum cleaner is in the parked position, wherein the rotation-locking device includes a first spring-mounted pin configured to engage a bore when the upper body is in the parked position.

2. An upright vacuum cleaner as recited in claim 1 further comprising a pin-moving device configured to move the first pin out of the bore when the upper body is pivoted from the parked position to the operating position.

3. The upright vacuum cleaner as recited in claim 2 wherein the pin-moving device includes an upwardly sloping cam surface and a second pin spring-mounted to the first pin.

4. The upright vacuum cleaner as recited in claim 1 wherein the first pin is disposed on a yoke-shaped member, the yoke-shaped member being a pivotable part of the tilting joint and a non-swiveling part of the swivel joint.

5. The upright vacuum cleaner as recited in claim 2 wherein the first pin is disposed on a yoke-shaped member, the yoke-shaped member being a pivotable part of the tilting joint and a non-swiveling part of the swivel joint.

6. The upright vacuum cleaner as recited in claim 1 wherein the first pin is disposed on a yoke-shaped member, the yoke-shaped member being a pivotable part of the tilting joint and a non-swiveling part of the swivel joint.

7. An upright vacuum cleaner for cleaning a surface, the upright vacuum cleaner comprising:

an upper body having a dust collection container disposed therein;

a base unit;

a carriage configured to move the base unit on the surface;

a tilting joint disposed between the base unit and the upper body, the tilting joint being operable to provide tilting of the upper body relative to the base unit about a horizontal axis from a vertical parked position to an inclined tilted operating position;

a swivel joint disposed between the base unit and the upper body, the swivel joint being operable to provide a change in a direction of travel of the base unit by twisting the upper body; and a rotation-locking device configured to lock the upper body against rotation when the vacuum cleaner is in the parked position, wherein the rotation-locking device includes a locking pin cooperating with a substantially V-shaped guide, the substantially V-shaped guide being configured to lock the locking pin when the upper body is in the operating position and release the locking pin when the upper body is moved out of the operating position.

* * * * *